US005799712A

United States Patent [19]

Kelly et al.

[11] Patent Number: 5,799,712

[45] Date of Patent: Sep. 1, 1998

[54] TONER CARTRIDGE TONER DAM REPLACEMENT AND METHOD THEREFOR

[75] Inventors: Gar P. Kelly; Bob Aaron; Dennis P. Davidson, all of Boise, Id.

[73] Assignee: Hewlett-Packard Company, Palo Alto, Calif.

[21] Appl. No.: 395,769

[22] Filed: Feb. 28, 1995

Related U.S. Application Data

[63] Continuation of Ser. No. 71,909, Jun. 1, 1993, abandoned.

[51] Int. Cl.[6] ..... G03G 15/06

[52] U.S. Cl. ..... 141/287; 141/364; 355/260; 156/344; 222/DIG. 1; 277/34.6

[58] Field of Search ..... 141/287, 312, 141/363–366, 368, 386; 277/34, 34.6, 226; 222/DIG. 1; 355/260; 156/344

[56] References Cited

U.S. PATENT DOCUMENTS

| | | | |
|---|---|---|---|
| 3,240,038 | 3/1966 | Schwegler | 277/34 |
| 4,930,684 | 6/1990 | Patterson | 222/DIG. 1 X |
| 4,937,628 | 6/1990 | Cirpolla et al. | 355/360 |
| 5,095,954 | 3/1992 | Wiese | 141/368 X |
| 5,150,807 | 9/1992 | Seyfried et al. | 355/260 X |
| 5,176,189 | 1/1993 | Perchthaler et al. | 141/287 X |
| 5,184,182 | 2/1993 | Michlin | 355/260 |
| 5,223,068 | 6/1993 | Baley | 156/344 X |
| 5,258,814 | 11/1993 | Davies | 355/260 |
| 5,282,003 | 1/1994 | Michlin | 355/260 |
| 5,296,902 | 3/1994 | Michlin | 355/260 |
| 5,335,831 | 8/1994 | Foster | 141/364 X |
| 5,370,761 | 12/1994 | Chitouras | 355/260 X |
| 5,383,502 | 1/1995 | Fisk et al. | 141/364 |

*Primary Examiner*—J. Casimer Jacyna

[57] ABSTRACT

In order to insert a replacement toner dam in an assembled toner cartridge, the opposing sides of the toner cartridge are caused to move towards each other so as to deform the cartridge and cause openings to appear at opposing ends thereof. A pair of web spring carriers are inserted into and through the openings so they exit from one opening. A new toner dam is inserted between web spring carriers at the portion thereof that exits from the opening. The web spring carriers are then withdrawn until the replacement toner dam is in a proper position. The dam is then held in position and the web spring carriers are freely withdrawn. This method thereby enables replacement of the toner dam without injury to seals at either end of the toner cartridge. Various non-adhesive bearing toner dam structures are shown, each of which has a flexible portion that engages a toner bottle flange and thereby enables a toner seal to be achieved without use of adhesive. Additional methods are described which require disassembly of a used toner cartridge and replacement of certain parts thereof.

2 Claims, 8 Drawing Sheets

162
160
158
156
166
154
164
150
152

TONER CARTRIDGE TONER DAM REPLACEMENT AND METHOD THEREFOR

This is a continuation of application Ser. No. 08/071,909 filed on Jun. 6, 1993, now abandoned.

FIELD OF THE INVENTION

This invention relates to replaceable toner cartridges that are used with electrostatic printers and copiers and, more particularly, to a method and apparatus for enabling reuse of used toner cartridges by replacement of toner dams therein.

BACKGROUND OF THE INVENTION

Laser printers and electrostatic copiers employ toner cartridges that contain a supply of toner material for use during the electrostatic development process. The cartridges are designed to be replaced from time to time, to replenish the toner that is used during the printing process. In addition to an electrostatic magnetic roller assembly, a toner cartridge includes (see FIG. 1) a toner bottle 10 and a cover 12 that includes a charging rod (not shown). Both toner bottle 10 and cover 12 have flanges that mate when cover 12 and bottle 10 are brought together. A polystyrene gasket 14 overlays flange 16 on bottle 10 and provides a substrate against which a removable tear strip 18 can be adhered. Toner dam 18 provides a damming action for toner contained within bottle 10 and prevents its leakage until it has been removed to render accessible the toner in bottle 10. A pair of foam seals 20 are placed at either end of cover 12 and act to prevent toner leakage once toner dam 18 has been removed.

During production, toner dam 18 is adhered to the upper surface of polystyrene gasket 14 which is, in turn, adhered to the upper surface of flange 16 of bottle 10. Top 12 is then brought into engagement, sandwiching toner dam 18 therebetween. The elongated flanges along the sides of top 12 are heat bonded to the elongated flanges of bottle 10 to create a unitary structure. Foam seals 20 are thereby compressed but enable withdrawal of toner dam 18 at some later time. Subsequently, through a hole in bottle 10, toner is inserted and the bottle is sealed and is ready for use.

While toner cartridges were initially designed to be discarded after the original toner supply was exhausted, other portions thereof (i.e., the magnetic roller and charging rods) have longer useful lives and thus a market has developed for cartridges that have been refilled with a supply of toner. However, replacement toner dams have not been satisfactory as they have enabled leakage of refilled toner. Furthermore, such replacement toner dams have used adhesive to adhere the dam to the bottle/top flanges. Such adhesives tend to collect toner and render the toner cartridge thereafter unusable for refilling.

In U.S. Pat. No. 5,080,745 to Paull, a replacement toner dam is described which includes a sealing sheet with an adhesive coating positioned on the sealing side thereof. A protective sheet is secured over the adhesive coating and is folded over the insertion edge of the sealing sheet and is further folded to extend out of the toner slot opening when the sealing sheet is in the inserted position. When the sealing sheet is inserted, the adhesive coating is exposed by pulling the adhesive covering sheet out of the toner slot, through the opening.

Accordingly, it is an object of this invention to provide a method and means for insertion of an improved replacement toner dam.

It is another object of this invention to provide an improved replacement toner dam for a toner cartridge.

It is yet another object of this invention to provide a replacement toner dam which, once used, does not render a toner cartridge unusable for succeeding replacement toner dams.

It is yet another object of this invention to provide a method for refurbishment of a used toner cartridge, the method enabling insertion of a non adhesive-bearing replacement toner dam.

SUMMARY OF THE INVENTION

In order to insert a replacement toner dam in an assembled toner cartridge, the opposing sides of the toner cartridge are caused to move towards each other so as to deform the cartridge and cause openings to appear at opposing ends thereof. A pair of web spring carriers are inserted into and through the openings so they exit from one opening. A new toner dam is inserted between the web spring carriers at the portion thereof that exits from the opening. The web spring carriers are then withdrawn until the replacement toner dam is in a proper position. The dam is then held in position and the web spring carriers are freely withdrawn. This method thereby enables replacement of the toner dam without injury to seals at either end of the toner cartridge. Various non-adhesive bearing toner dam structures are shown, each of which has a flexible portion that engages a toner bottle flange and thereby enables a toner seal to be achieved without use of adhesive. Additional methods are described which require disassembly of a used toner cartridge and replacement of certain parts thereof.

DETAILED DESCRIPTION OF THE INVENTION

Figure 1:
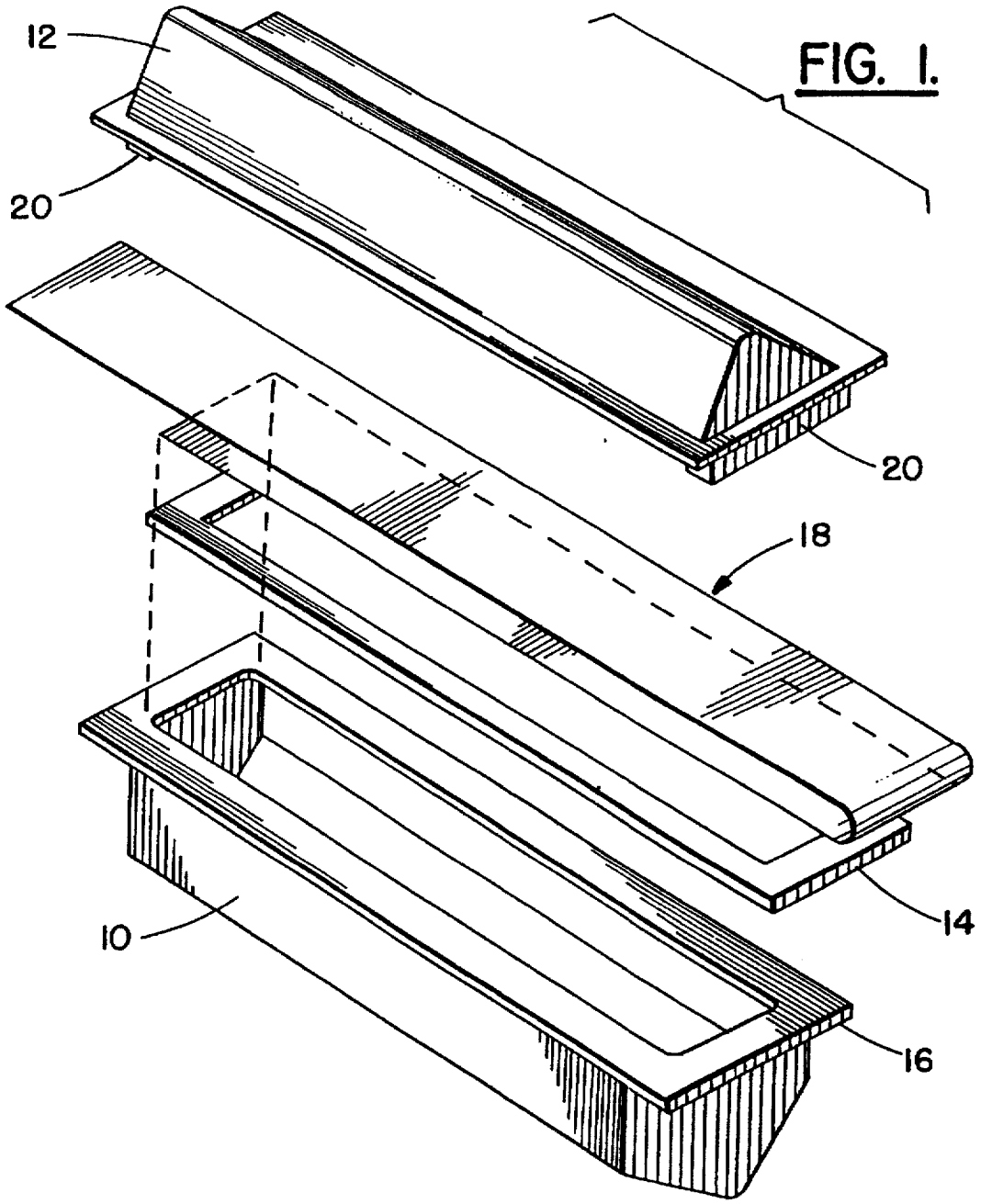
FIG. 1 is an exploded view of a prior art toner cartridge.
Figure 2:
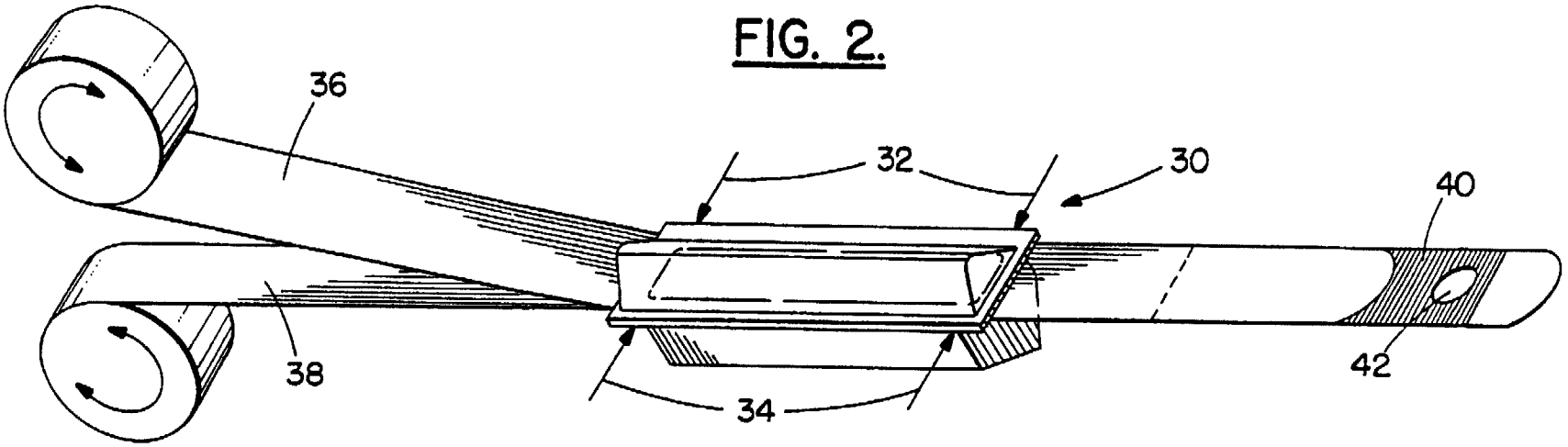
FIG. 2 shows the use of web spring carriers for replacing a toner dam.
Figure 3:
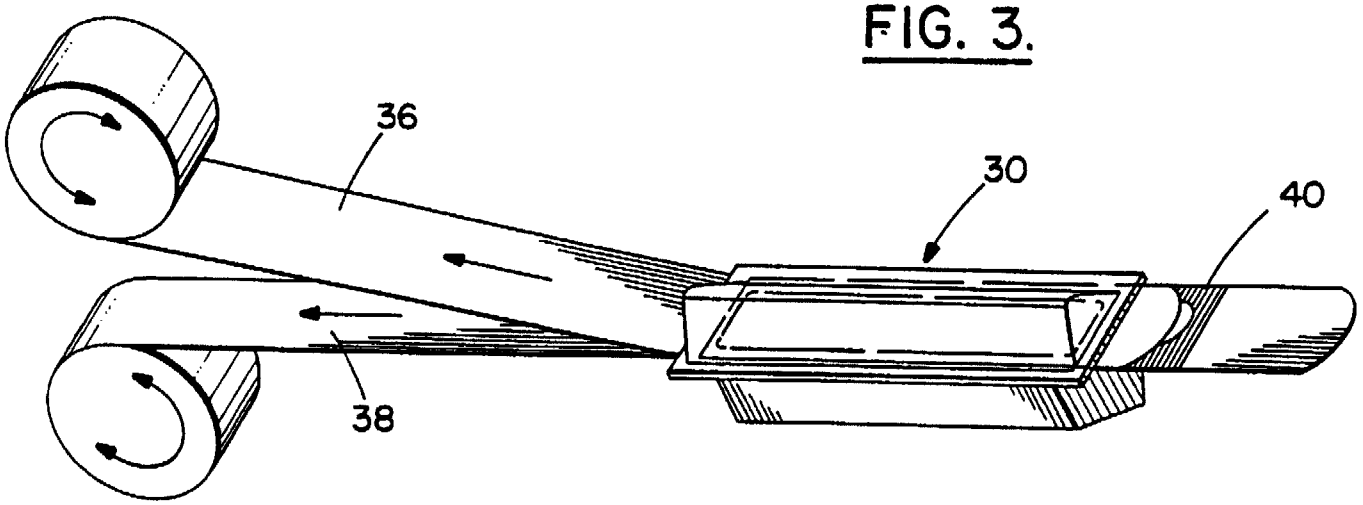
FIG. 3 illustrates the withdrawal of the web spring carriers into a position that properly orients a replacement toner dam over the toner bottle opening.

As indicated above with respect to FIG. 1, foam seals 20 are positioned at the ends of an assembled toner cartridge. When an attempt is made to insert a replacement toner dam, it has been found that damage often results to the foam seal, thereby enabling substantial toner leakage. Damage to foam seals 20 can be avoided during toner dam replacement through a procedure illustrated in FIGS. 2 and 3.

A toner cartridge 30, that is to have a toner dam replaced, is placed in a vice-like arrangement (not shown) which causes light pressure to be exerted on opposing cartridge flanges in directions generally shown by arrows 32 and 34. As a result, the ends of toner cartridge 30 are caused to move apart, thereby exposing a channel for insertion of a pair of sandwiched, spring steel carrier webs 36 and 38. Once spring steel webs 36 and 38 are fully inserted through toner cartridge 30 (see FIG. 2), a replacement toner dam 40 is sandwiched therebetween and spring steel carriers 36 and 38 are moved to the left (see FIG. 3). When toner dam 40 is properly positioned, an aperture 42 therein is engaged by a stop so as to prevent further movement of toner dam 40 as spring steel carriers 36 and 38 are completely withdrawn from toner cartridge 30. At such time, side pressures 32 and 34 are released and replacement toner dam 40 is securely held in place.

Figure 4:
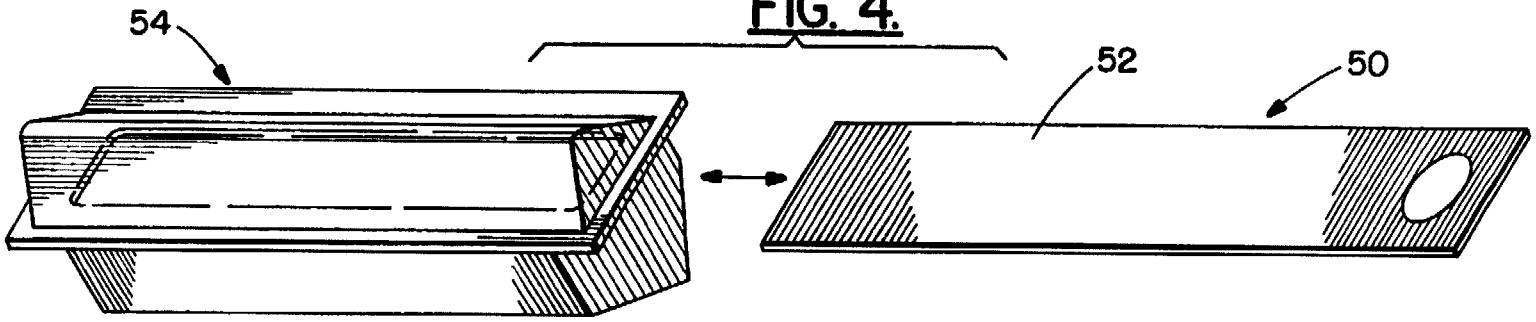
FIG. 4 illustrates a replacement toner dam with a flocked surface that enables a resilient seal to be obtained between the toner dam and a toner cartridge surface.
Figure 4A:
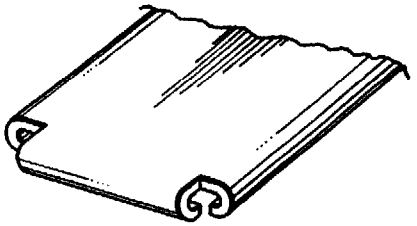
FIG. 4*a* illustrates that the edges of the toner dam, shown in FIG. 4, may be folded so as to achieve more resilient sealing edges.

It has been found that a replacement toner dam that comprises a single rigid sheet (e.g. of polystyrene) does not provide a sufficient sealing action to prevent toner leakage. It has been found, however, that when a replacement toner dam is provided with resilient means that force the toner dam into engagement with a mating flange surface, that appropriate toner sealing action is accomplished. In FIG. 4, a replacement toner dam 50 is shown whose non-toner facing side 52 has been coated with a polymeric flocking material. When toner dam 50 is inserted into toner cartridge 54, flocking material 52 acts to bias the underside of toner dam 50 against mating flange portions of toner bottle 56. If additional resilience is required to accomplish an appropriate sealing action, the edges of toner dam 50 may be folded so as to create a more resilient sealing structure (see FIG. 4*a*).

Figure 5A:
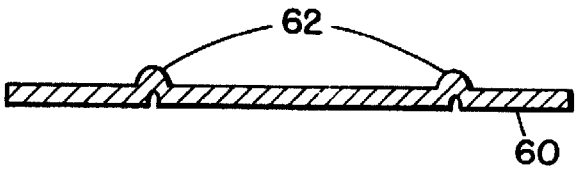
FIG. 5*a* is a section of the toner dam shown in FIG. 5, taken along line A—A.
Figure 5:
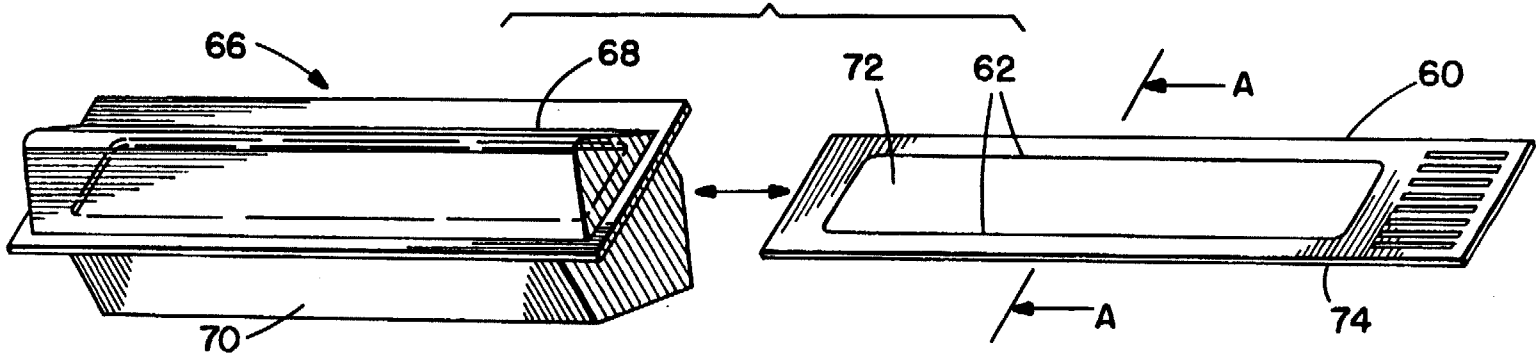
FIG. 5 illustrates a replacement toner dam which has been thermoformed to have a resilient ridge that, upon insertion, engages a surface of the toner cartridge.

A further embodiment of a replacement toner dam is shown at 60 in FIG. 5. A continuous deformed ridge 62 extends about the upper surface of toner dam 60 and is preferably formed (see FIG. 5*a*) by thermal deformation of the plastic material from which toner dam 60 is constructed (e.g., polystyrene). When toner dam 60 is inserted into toner cartridge 66, ridges 62 engage flange portions of cover 68 and force the underside of toner dam 60 into a sealing relationship with the flange portions of toner bottle 70. Because end portions 72 and 74 of ridge 62 engage foam seals 20 (see FIG. 1), it is also preferable that portions 72 and 74 of ridge 62 be formed to a greater height so as to assure a more effective sealing action.

Figure 6:
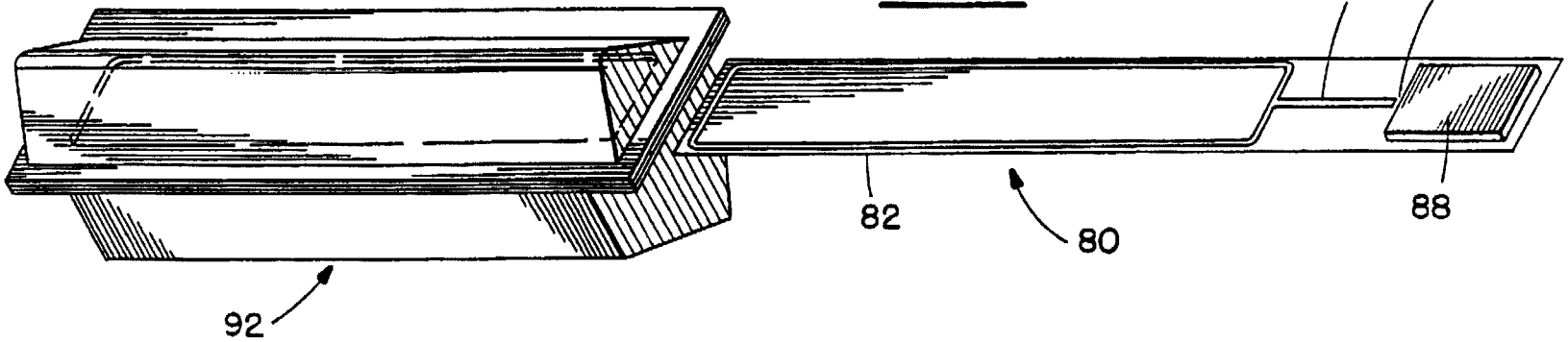
FIG. 6 illustrates an embodiment of a toner dam which employs a fluid-filled cavity to expand flexible channels within the toner dam so as to create a desired sealing action after toner dam insertion.

In FIG. 6, a further embodiment of a toner dam is shown that employs an expandable sealing feature. Toner dam 80 includes a continuous flexible channel 82. Channel 82 is connected via a tube 86 to a fluid reservoir 88. A breakable seal 90 separates tube 86 from fluid contained within reservoir 88. Reservoir 88 may be filled with air or another appropriate, relatively incompressible fluid.

Upon the insertion of toner dam 80 into toner cartridge 92, a pressure is applied to reservoir 88 causing seal 90 to rupture and the fluid therein to enter channel 82, causing an expansion thereof. If pressure is maintained upon reservoir 88, the fluid remains within channel 82 and enables a sealing action to occur with respect to mating surfaces within toner cartridge 92.

Figure 7A:
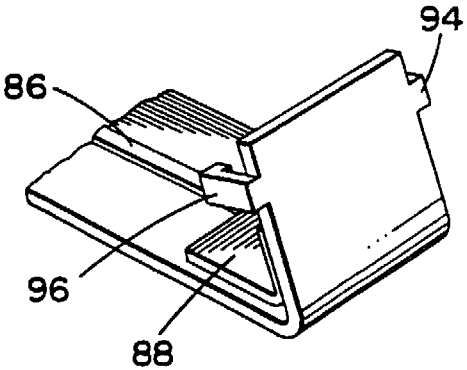
FIG. 7A is a perspective view of the toner dam of FIG. 6 as it is folded to pressurize a fluid reservoir.
Figure 7:
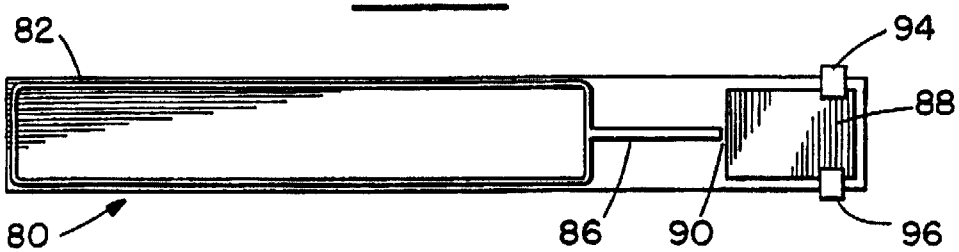
FIG. 7 is a plan view of an embodiment of the toner dam shown in FIG. 6.
Figure 8:
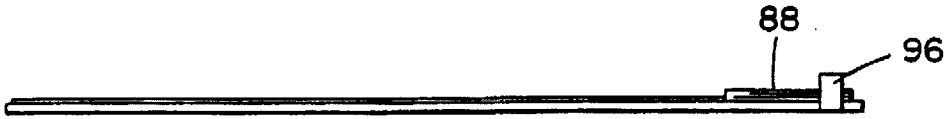
FIG. 8 is a side view of the toner dam shown in FIG. 7.

In FIG. 7, a plan view of toner dam 80 is shown and includes a pair of side clips 94 and 96 (not shown in FIG. 6). Beneath reservoir 88 is a necked down portion (not shown) of the substrate comprising toner dam 80 which enables one portion of reservoir 88 to be folded upon itself to thereby create a pressurization of the fluid therein (see FIG. 7A). Clips 94 and 96 engage and clip onto the substrate after the folding action has occurred. In this manner, the fluid within reservoir 88 is both pressurized and the pressurization is maintained by the mechanical clipping action of clips 94 and 96.

Figure 9:
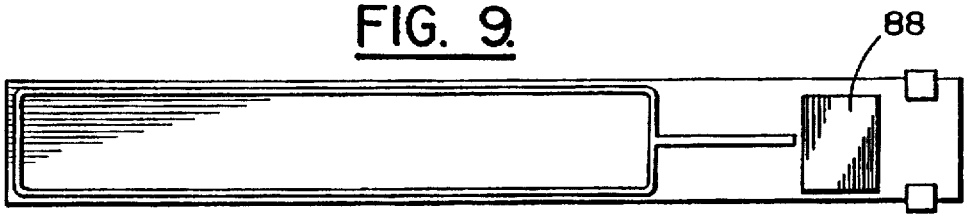
FIG. 9 is a plan view of an embodiment of the toner dam shown in FIG. 6 having a foldable portion which enables pressure to be exerted and maintained on a fluid reservoir.
Figure 10:
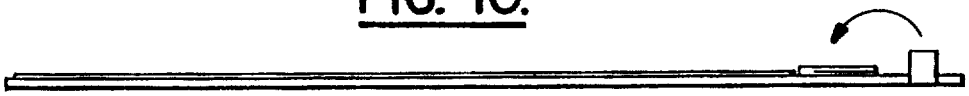
FIG. 10 is a side view of the toner dam shown in FIG. 9.
Figure 10A:
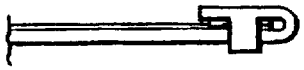
FIG. 10A shows the configuration of the toner dam of FIG. 9, when an end has been folded upon the fluid reservoir.

In FIGS. 9, 10 and 10*a*, a similar structure is illustrated, however, in this instance, fluid reservoir 88 has a somewhat smaller capacity and the portion of the substrate of toner dam 80 which is folded over reservoir 88 does not contain any portion of reservoir 88. In this manner, the chances of rupturing reservoir 88 are lessened.

Figure 11:
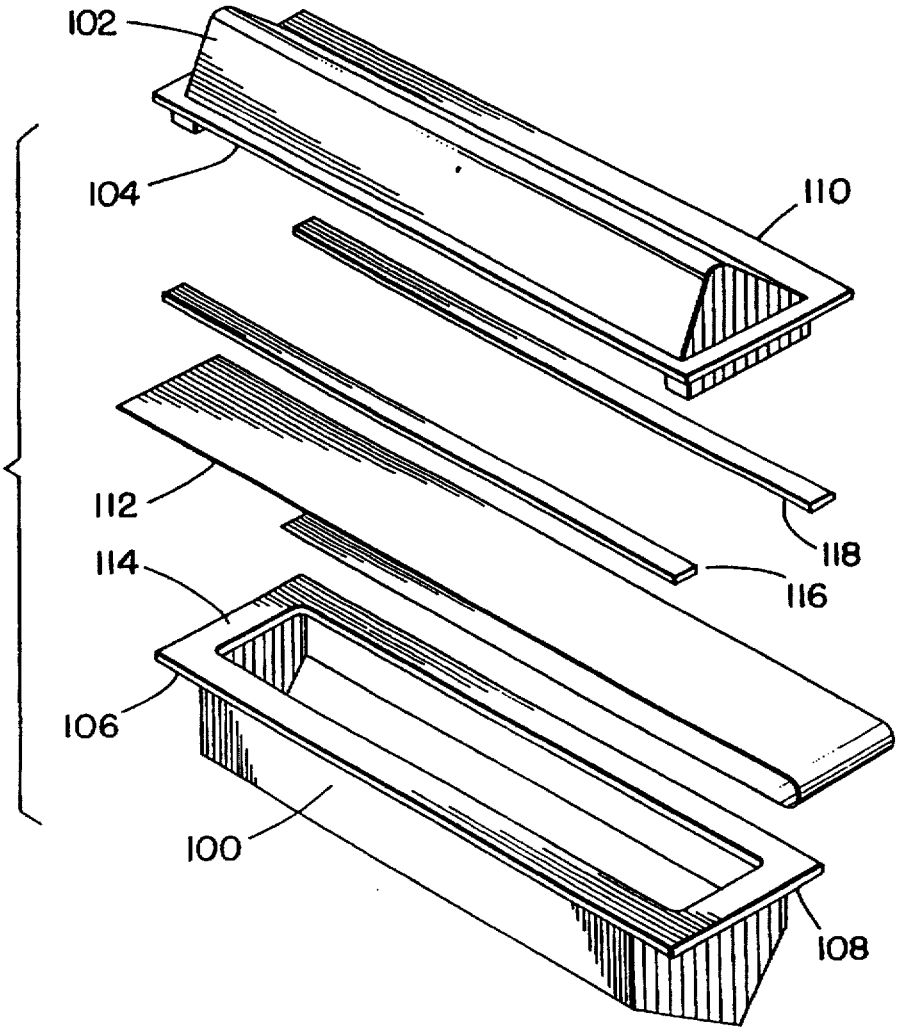
FIG. 11 is an exploded view of a toner cartridge that has been refurbished in accordance with a method of the invention.

At times, removal of a toner dam from a new toner cartridge may cause internal warpage of the polystyrene gasket between the toner cover and the toner bottle. Under such a circumstance, a simple insertion of a new toner dam will not result in the creation of an effective seal for the toner bottle. In FIG. 11, a technique is illustrated for refurbishing a used toner cartridge which involves disassembly of the cartridge and insertion of both a new toner dam and a pair of hot-melt adhesive preforms for the rejoining process. In FIG. 11, toner bottle 100 has been separated from toner cover 102 by running a saw along adjoining flanges 104, 106 and 108, 110. As a result, cover 102 is separated from toner bottle 100. A new toner dam 112 is then heat staked to the upper surface of polystyrene gasket 114 that resides on flanges 106, 108. A pair of hot melt adhesive preforms 116, 118 are then emplaced on polystyrene gasket 114, on either side of toner dam 112. Each of preforms 116, 118 is impregnated with metallic particles (e.g. iron) to enable selective absorption of heat during a subsequent joining process.

Toner cover 102 is now emplaced over preforms 116, 118, and an inductive heater makes contact with flanges 104, 110 to cause the joining thereof (via preforms 116, 118) to flanges 106, 108 (via gasket 114) of bottle 100. The metallic inserts in preforms 116, 118 enable a faster, selective heating thereof and prevent undue heating of the polymeric materials from which bottle 100 and cover 102 are comprised.

Figure 12:
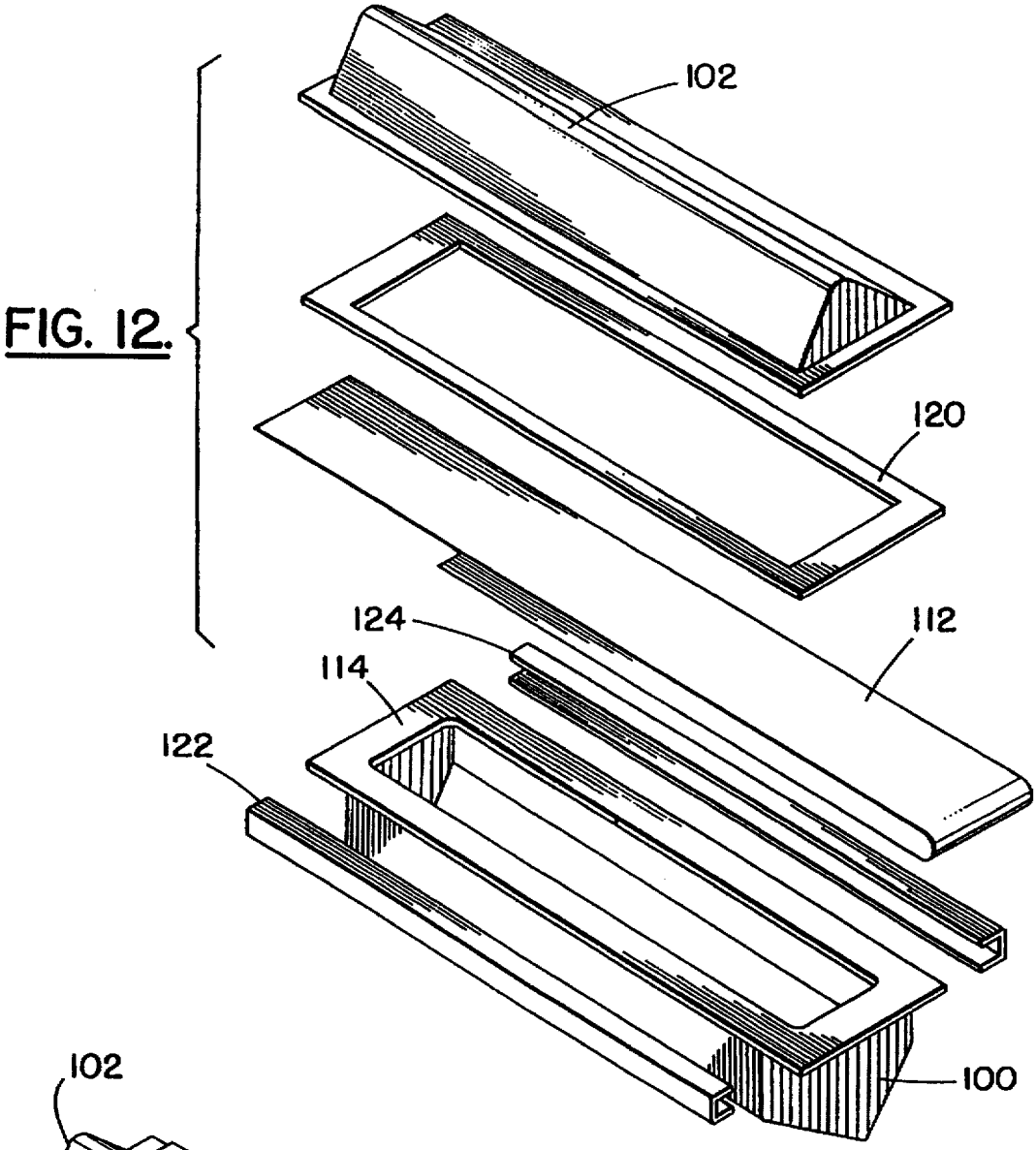
FIG. 12 is an exploded view of another embodiment of the invention wherein a toner cartridge has been disassembled and is reassembled employing side clips to maintain toner cartridge integrity.
Figure 13:
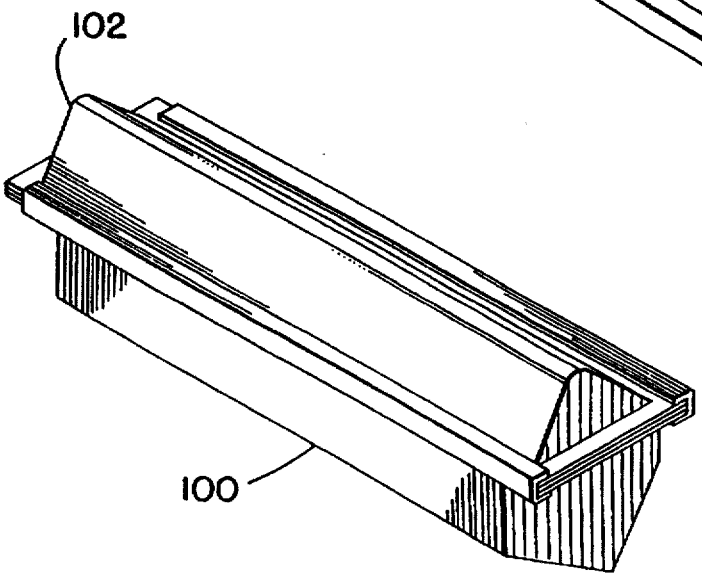
FIG. 13 is an assembled view of the toner cartridge shown in FIG. 12.

A further toner dam replacement procedure is illustrated in FIGS. 12 and 13. Toner bottle 100 is disassembled from toner cover 102 in the manner described with respect to FIG. 11. In this instance, after new toner dam 112 is staked to styrene gasket 114, a closed cell foam gasket 120 is emplaced over gasket 114 and cover 102 is brought into contact with gasket 114. A pair of elongated clips 122, 124 are employed to clip together the flange edges of toner bottle 100 to toner cover 102, to thereby cause compression of foam gasket 120. To maintain foam cell gasket 120 in place, it may be provided with adhesive on its planar surfaces. An assembled version of the refurbished toner bottle is shown in FIG. 13.

Figure 14:
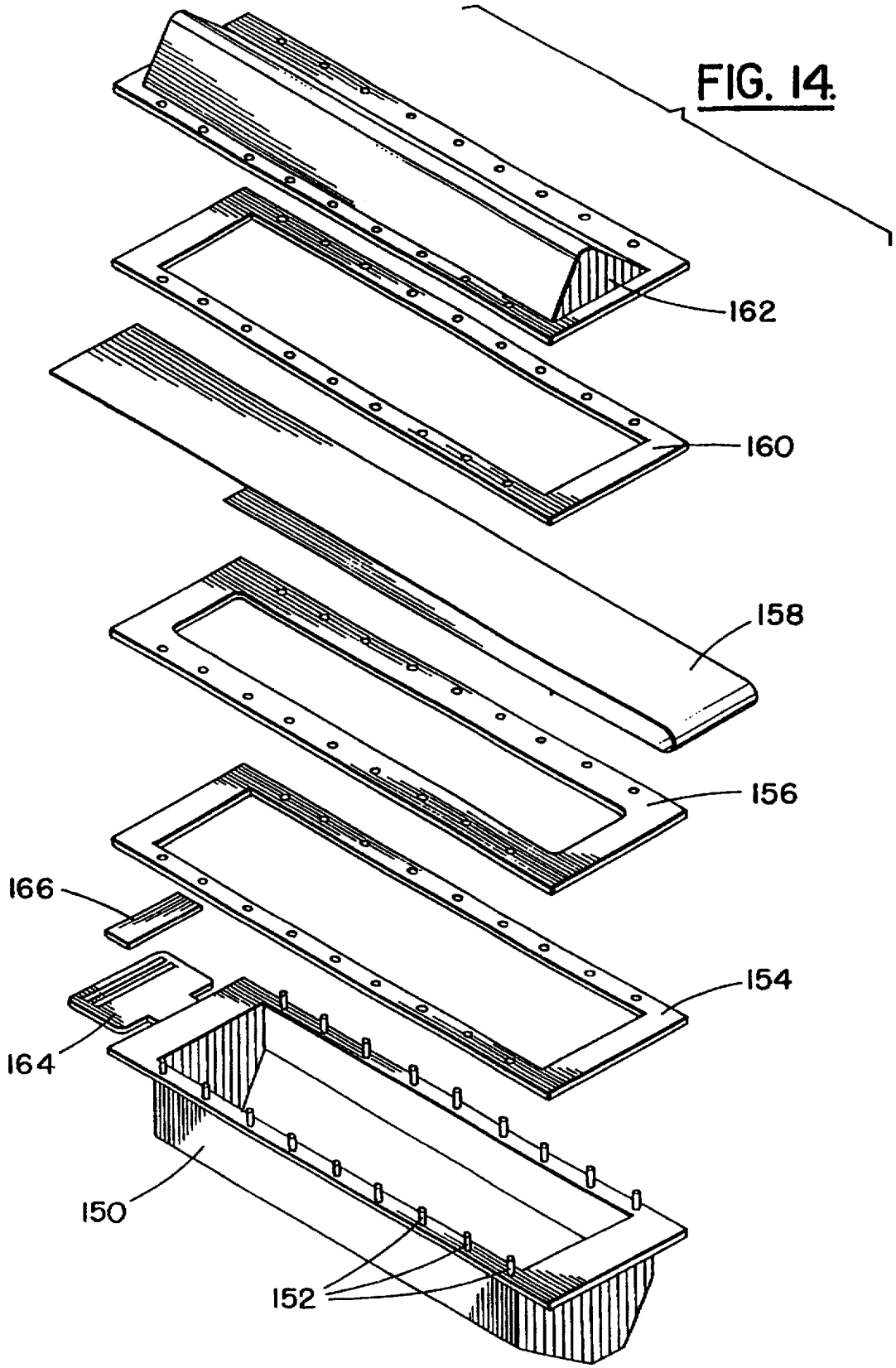
FIG. 14 is another embodiment of a disassembled, refurbished toner cartridge wherein a new toner dam has been inserted.

In FIG. 14, another technique for refurbishment of a used toner cartridge is shown. In this instance, after disassembly, the used toner bottle is discarded and a new toner bottle 150 is substituted. Toner bottle 150 is provided with a plurality of extending pins 152 that enable alignment of a foam gasket 154, and a polystyrene gasket 156 via alignment holes provided therein. A new toner dam 158 is bonded to gasket 156 and a further foam gasket 160 is emplaced thereover, followed by toner cover 162. Pins 152 enable alignment of each of the components and, when assembly is completed, each of pins 152 is heat staked to cause a bonding of cover 162 to toner bottle 150.

A breakable arm 164 is bonded, via glue insert 166, to an extended end of toner dam 158. Thus, when arm 164 is detached from toner bottle 150, toner dam 158 can be withdrawn from the assembled toner cartridge to thereby enable access to toner within toner bottle 150.

Figure 15:
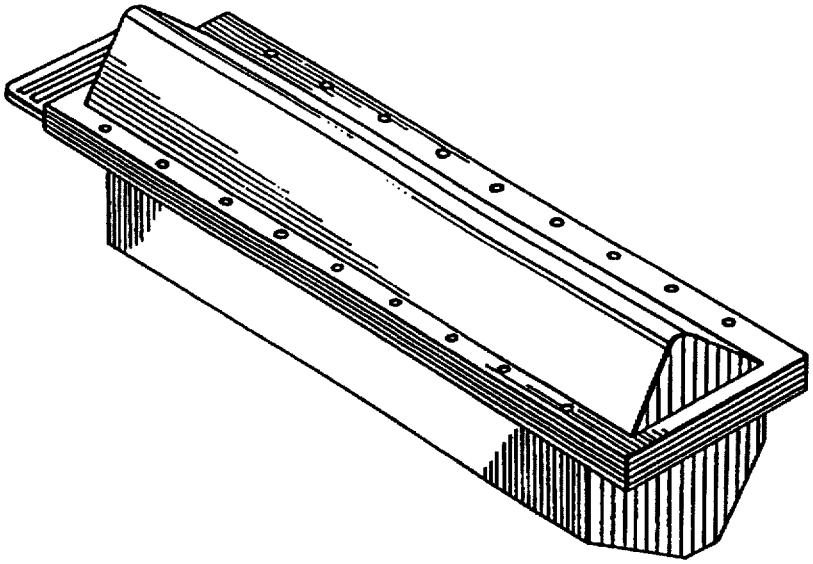
FIG. 15 is an assembled view of the toner cartridge shown in FIG. 14.

In lieu of emplacing pins 152 on toner bottle 150, they may be molded as part of polystyrene gasket 156 (extending from either surface thereof). An assembled toner cartridge constructed in accordance with the exploded view of FIG. 14 is shown in FIG. 15.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A toner dam for an elongated-dimension toner cartridge having relatively narrow ends, said toner cartridge comprising a toner bottle and bottle cover, both toner bottle and bottle cover having flanges encompassing openings therein and a gasket positioned between said flanges, said flanges and gasket adherent to each other along said elongated dimension so as to align said openings in said toner bottle and bottle cover, said relatively narrow ends each having a resilient seal positioned therein, said toner dam comprising:

a planar, rigid sheet having two major planar surfaces, said rigid sheet sized to completely cover and seal said aligned openings when inserted between said toner bottle and bottle cover, said rigid sheet including resilient means, said resilient means extending from one said major planar surface thereof and positioned to directly engage and seal against a proximate flange surface upon insertion of said planar rigid sheet therebetween, said resilient means further comprising an enclosed, flexible channel about a periphery thereof, said enclosed flexible channel communicating with a compressible fluid-filled reservoir via a passage having a breakable seal positioned therein, and further including means for compressing said fluid-filled reservoir to increase fluid pressure therein to a point where said breakable seal is ruptured and said fluid is forced from said reservoir into said flexible channel, thereby causing an expansion thereof to create said resilient means.

2. The toner dam as recited in claim 1, wherein said means for compressing said fluid-filled reservoir includes a foldable portion of said planar, rigid sheet, said foldable portion positioned to compress said fluid-filled reservoir and further having clips at its extremities to engage edges of said planar, rigid sheet to maintain a continuing level of pressure on said fluid-filled reservoir.

* * * * *